US009518539B2

(12) United States Patent
Kragh et al.

(10) Patent No.: US 9,518,539 B2
(45) Date of Patent: Dec. 13, 2016

(54) SYSTEMS AND METHODS FOR PURGE AIR FLOW ROUTING

(71) Applicant: Ford Global Technologies, LLC, Dearborn, MI (US)

(72) Inventors: Niels Christopher Kragh, Commerce Township, MI (US); Mark W. Peters, Wolverine Lake, MI (US); Donald Ignasiak, Farmington Hills, MI (US); Mike Dong, Ann Arbor, MI (US); Dhaval P. Vaishnav, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 319 days.

(21) Appl. No.: 14/275,453

(22) Filed: May 12, 2014

(65) Prior Publication Data

US 2015/0322901 A1 Nov. 12, 2015

(51) Int. Cl.
*F02M 25/08* (2006.01)

(52) U.S. Cl.
CPC ..... *F02M 25/089* (2013.01); *F02M 25/08* (2013.01); *F02M 2025/0881* (2013.01)

(58) Field of Classification Search
CPC F02M 25/08; F02M 25/0836; F02M 25/0872; F02M 2025/0881; F02M 25/089
See application file for complete search history.

(56) References Cited

U.S. PATENT DOCUMENTS

| | | | | |
|---|---|---|---|---|
| 4,130,095 | A | 12/1978 | Bowler et al. | |
| 8,337,171 | B2 | 12/2012 | Agner et al. | |
| 2004/0112119 | A1* | 6/2004 | Watanabe | F02M 25/0809 73/40 |
| 2006/0065253 | A1 | 3/2006 | Reddy | |
| 2007/0266997 | A1 | 11/2007 | Clontz, Jr. et al. | |
| 2012/0123635 | A1* | 5/2012 | Brevick | F02M 31/04 701/36 |
| 2012/0234120 | A1 | 9/2012 | Fukuda et al. | |
| 2013/0233287 | A1 | 9/2013 | Leone | |
| 2013/0291839 | A1 | 11/2013 | Lin et al. | |
| 2014/0123961 | A1 | 5/2014 | Kragh et al. | |

OTHER PUBLICATIONS

Peters, Mark W. et al., "Systems and Methods for a Two-Valve Non-Integrated Refueling Canister Only System," U.S. Appl. No. 14/024,416, filed Sep. 11, 2013, 32 pages.
Werner, Matthew et al., "System and Methods for Canister Purging with Low Manifold Vacuum," U.S. Appl. No. 14/069,191, filed Oct. 31, 2013, 30 pages.

* cited by examiner

*Primary Examiner* — Jacob Amick
(74) *Attorney, Agent, or Firm* — James Dottavio; Alleman Hall McCoy Russell & Tuttle LLP

(57) ABSTRACT

A method, comprising: purging fuel vapors from a fuel vapor canister and/or a fuel vapor bleed element to an engine intake with air routed through a transmission bellhousing. In this way, purge air may be warmed by heat generated in the transmission bellhousing during engine operation, thereby increasing desorption efficiency and reducing bleed emissions. Further, purge air may be pressurized in the transmission bellhousing to allow purging operations irrespective of intake manifold vacuum.

20 Claims, 6 Drawing Sheets

SYSTEMS AND METHODS FOR PURGE AIR FLOW ROUTING

BACKGROUND AND SUMMARY

Figure 1:
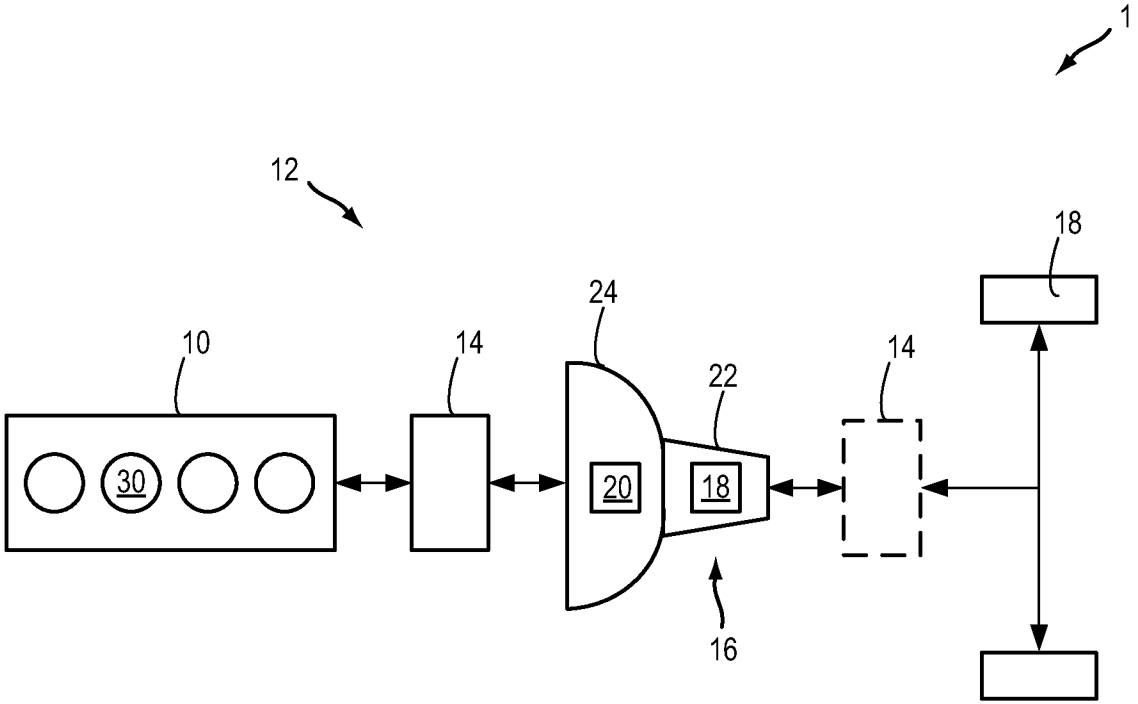

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve coupled between the engine intake and the fuel canister is opened, allowing for intake manifold vacuum to be applied to the fuel canister. Simultaneously, a canister vent valve coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

However, hybrid vehicles and other low-manifold vacuum vehicles may have limited engine run-time with sufficient manifold vacuum to execute a purging operation. As an alternative, the purged fuel vapors may be directed to engine intake upstream of the throttle body, but this requires a diverter valve to lower local pressure in the engine intake, thereby adding manufacturing costs. Further, the desorption of fuel vapors is an endothermic reaction, the desorption efficiency decreasing as the canister temperature drops. Dedicated heating elements have been used to warm the fuel vapor canister and/or purge air entering the canister, but this again adds manufacturing costs and increases the power demand on the vehicle battery during operation.

The inventors herein have recognized the above problems, and have developed systems and methods to at least partially address them. In one example, a method, comprising: purging fuel vapors from a fuel vapor canister and/or a fuel vapor bleed element to an engine intake with air routed through a transmission bellhousing. In this way, purge air may be warmed by heat generated in the transmission bellhousing during engine operation, thereby increasing desorption efficiency and reducing bleed emissions.

In another example, an engine system, comprising: a fuel vapor canister coupled to a fuel tank; a fuel vapor bleed element coupled to the fuel vapor canister, a purge line coupled between the an engine intake and one or more of the fuel vapor canister and fuel vapor bleed element; a vent line coupled between a transmission bellhousing and one or more of the fuel vapor canister and fuel vapor bleed element; and one or more air inlets coupled between the transmission bellhousing and atmosphere. The transmission bellhousing may be configured to pressurize atmospheric air between a bellhousing wall and a ring gear, and further configured to flow pressurized air to the fuel vapor canister and/or fuel vapor bleed element via the vent line. In this way, purge air may be generated regardless of engine manifold vacuum, allowing for increased opportunities to perform purge operations. This may in turn reduce bleed emissions, as well as increase engine efficiency, as intake vacuum maybe maintained at a low level. Further, a diverter valve may be omitted, decreasing manufacturing costs and system complexity.

In yet another example, a method for purging a fuel vapor canister, comprising: opening a purge valve coupled between the fuel vapor canister and an engine intake; opening a vent valve coupled between the fuel vapor canister and a transmission bellhousing; flowing atmospheric air into the transmission bellhousing via an air filter; transferring heat to the atmospheric air; pressurizing the atmospheric air in the transmission bellhousing between a bellhousing wall and a ring gear; flowing the heated, pressurized atmospheric air to the fuel vapor canister to purge fuel vapor stored in the fuel vapor canister; and flowing the purged fuel vapor to the engine intake. In this way, purge air may be heated without the addition of a dedicated canister heater or purge air heater. This may reduce manufacturing costs, and increase the efficiency of the vehicle engine and battery, as no additional power or voltage needs to be supplied to warm purge air.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows an example of a hybrid propulsion system for a vehicle.

Figure 2:
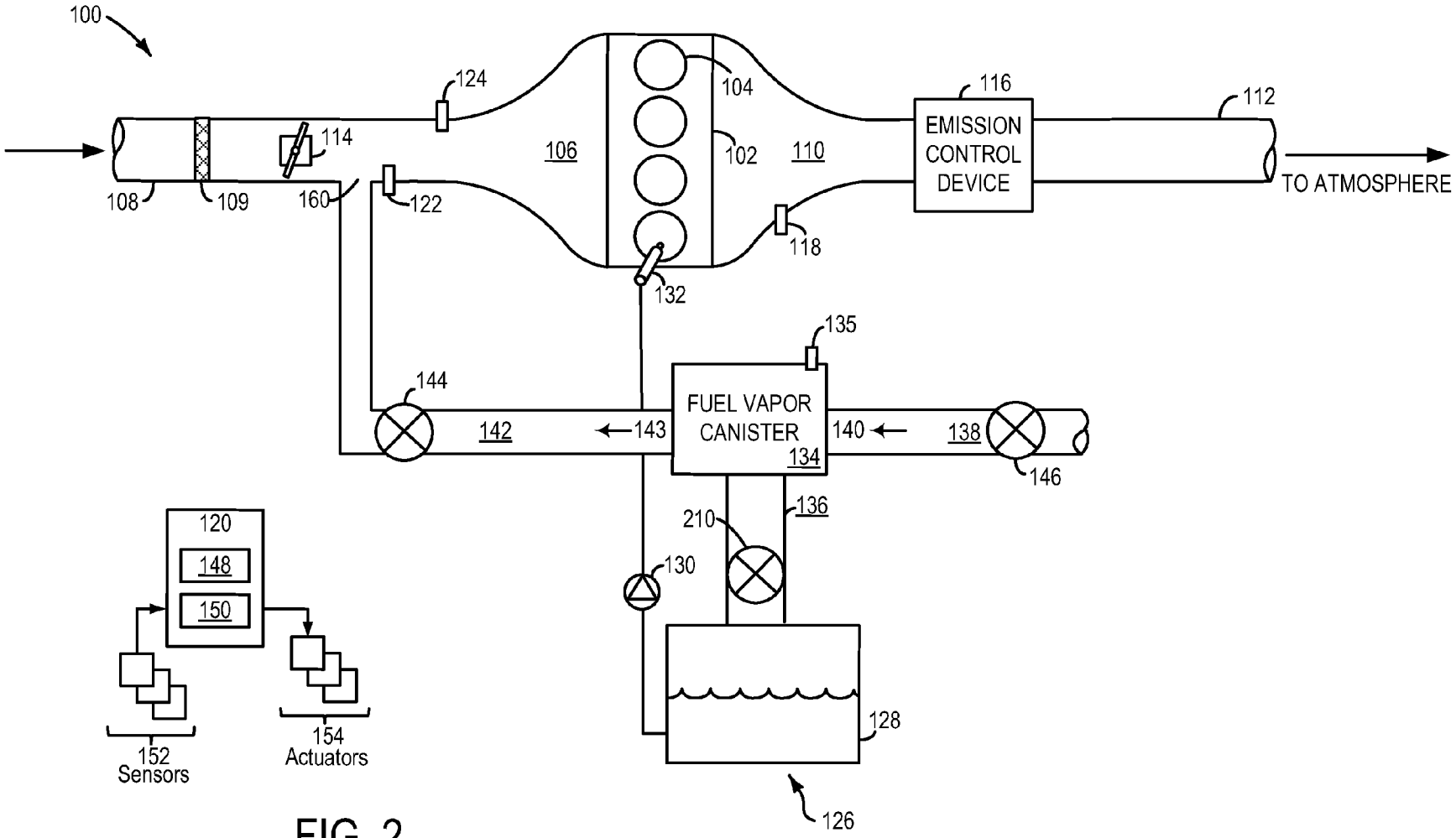

FIG. 2 schematically shows an example of an engine system and an associated fuel system.

Figure 3A:
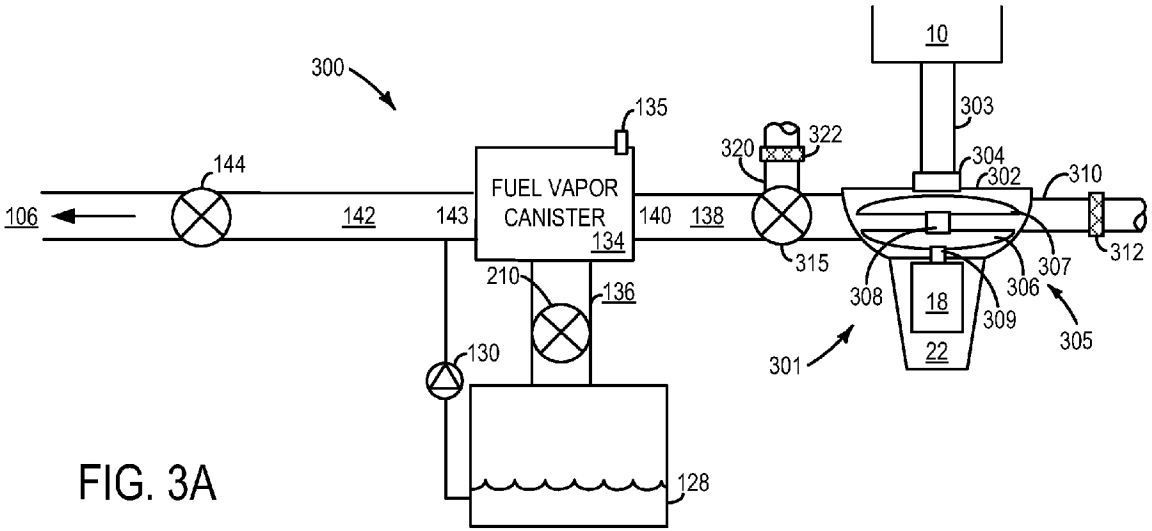
Figure 3B:
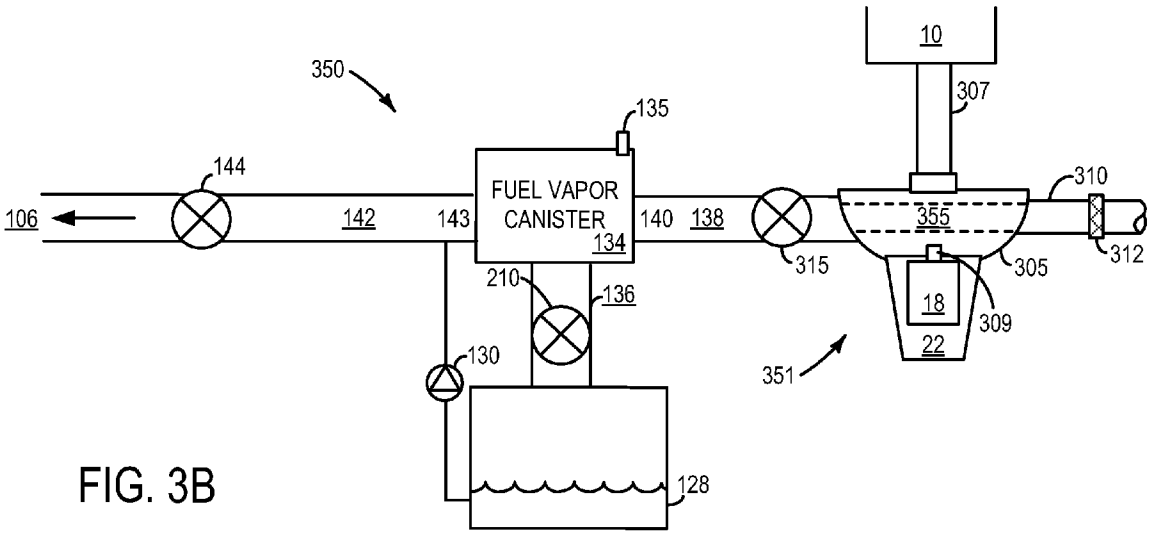

FIGS. 3A-3B schematically show example fuel systems in accordance with the present disclosure.

Figure 4:
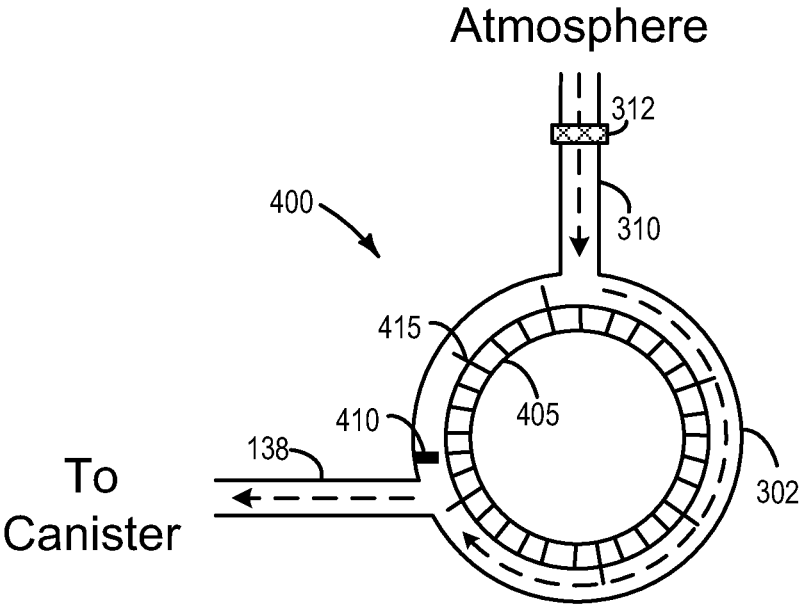
Figure 5:
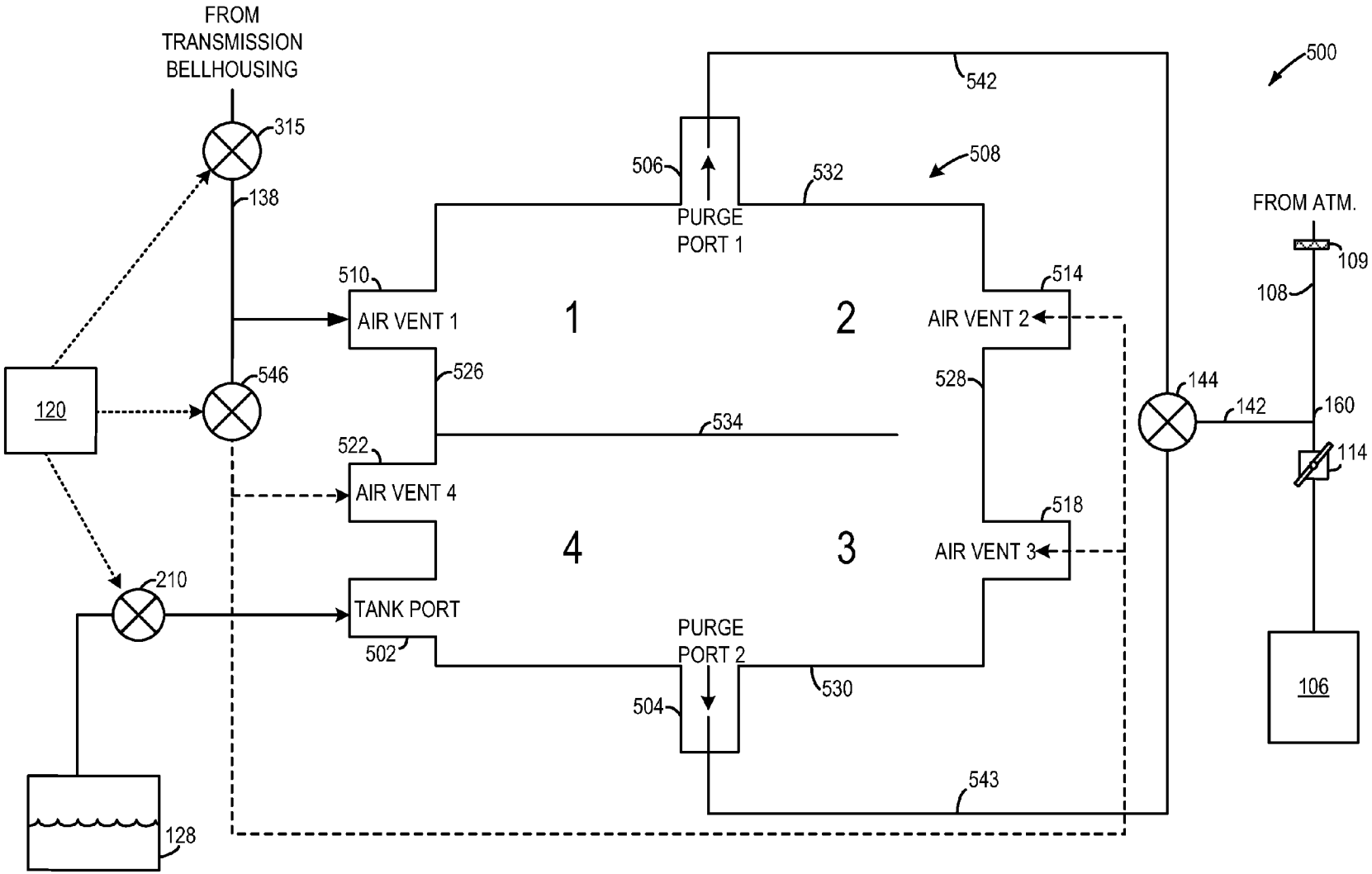

FIG. 4 schematically shows a purge air routing system in accordance with the present disclosure FIG. 5 schematically shows an example fuel vapor canister coupled to the systems depicted in FIGS. 2, 3A and 4.

Figure 6:
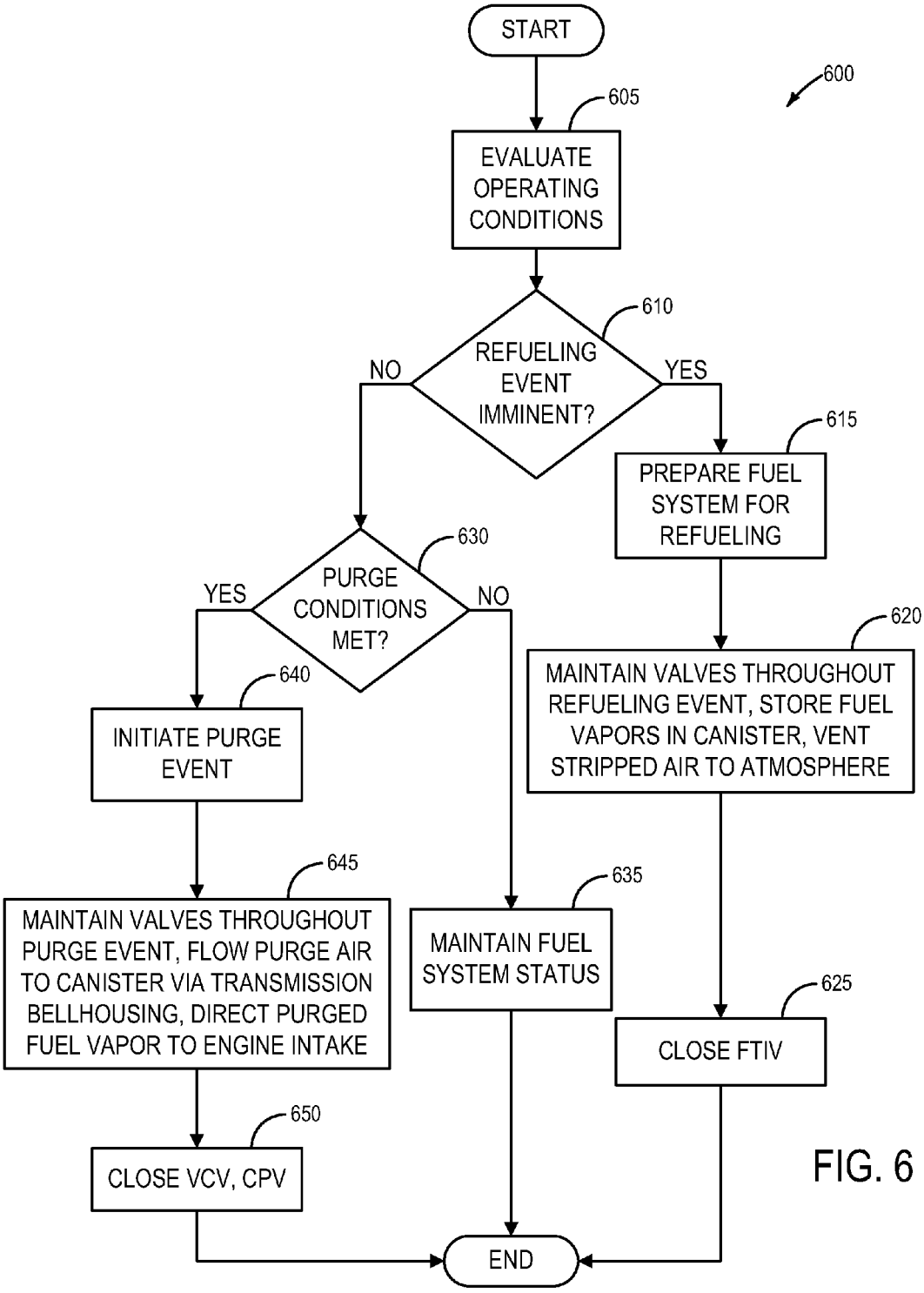

FIG. 6 shows an example flowchart for a high-level method for managing evaporative emissions in accordance with the present disclosure.

DETAILED DESCRIPTION

This detailed description relates to systems and methods for an evaporative emissions system for a vehicle. In particular, the description relates to systems and methods for routing purge air through a transmission bellhousing in order to heat and/or pressurize air that is then routed to a fuel vapor canister to promote the desorption of fuel vapor. The vehicle may be a hybrid vehicle, such as the hybrid vehicle shown schematically in FIG. 1. The vehicle may have an engine coupled to an evaporative emissions system, as depicted in FIG. 2. The evaporative emissions system may include a fuel vapor canister configured to store fuel vapors generated in a fuel tank. The stored fuel vapors may be purged to an intake of the engine for combustion. In order to improve the desorption efficiency of the purge operation, intake air may be routed through a transmission bellhousing where the air may be heated, as shown in FIGS. 3A and 3B. The rotation of elements within the bellhousing may be used to pressurize intake air as shown in FIG. 4. The fuel vapor canister may be a mulit-port canister, such as the canister depicted in FIG. 5. FIG. 6 shows an example method for storing and purging fuel vapors in the systems of FIGS. 1-5.

FIG. 1 schematically shows an example of a vehicle system 1 according to an embodiment of the present disclosure. The vehicle 1 includes a hybrid propulsion system 12. The hybrid propulsion system 12 includes an internal combustion engine 10 having one or more cylinders 30, a transmission 16, drive wheels 18 or other suitable device for delivering propulsive force to the ground surface, and one or more motors 14. In this way, the vehicle may be propelled by at least one of the engine or the motor. The engine may include a turbocharger boosting intake air, the turbocharger including a compressor and a turbine, the turbine driven by exhaust flow. Transmission 16 may be coupled to motor 14 and engine 10 via a torque converter or manual flywheel 20. Transmission 16 may include gearbox 18, and may be enclosed within transmission housing 22. Torque converter/manual flywheel 20 may be enclosed within transmission bellhousing 24. Transmission housing 22 and transmission bellhousing 24 may form a continuous enclosure, and may also be continuous with a housing for one or more motors 14.

In the illustrated example, one or more of the motors 14 may be operated to supply or absorb torque from the driveline with or without torque being provided by the engine. Accordingly, the engine 10 may operate on a limited basis. Correspondingly, there may be limited opportunity for fuel vapor purging to control evaporative emissions. It will be appreciated that the vehicle is merely one example, and still other configurations are possible. Therefore, it should be appreciated that other suitable hybrid configurations or variations thereof may be used with regards to the approaches and methods described herein. Moreover, the systems and methods described herein may be applicable to non-HEVs, such as vehicles that do not include a motor and are merely powered by an internal combustion. FIG. 2 schematically shows an example of an engine system 100 according to an embodiment of the present disclosure. For example, the engine system 100 may be implemented in the vehicle system 1 shown in FIG. 1. The engine system 100 includes an engine block 102 having a plurality of cylinders 104. The cylinders 104 may receive intake air from an intake manifold 106 via an intake passage 108 and may exhaust combustion gases to an exhaust manifold 110 and further to the atmosphere via exhaust passage 112. The intake air received in the intake passage 108 may be cleaned upon passage through an intake air cleaner 109.

The intake passage 108 may include a throttle 114. In this particular example, the position of the throttle 114 may be varied by a controller 120 via a signal provided to an electric motor or actuator included with the throttle 114, a configuration that is commonly referred to as electronic throttle control (ETC). In this manner, the throttle 114 may be operated to vary the intake air provided to the plurality of cylinders 104. The intake passage 108 may include a mass air flow sensor 122 and a manifold air pressure sensor 124 for providing respective signals MAF and MAP to the controller 120.

An emission control device 116 is shown arranged along the exhaust passage 112. The emission control device 116 may be a three way catalyst (TWC), NOx trap, various other emission control devices, or combinations thereof. In some embodiments, during operation of the engine 100, the emission control device 116 may be periodically reset by operating at least one cylinder of the engine within a particular air/fuel ratio. An exhaust gas sensor 118 is shown coupled to the exhaust passage 112 upstream of the emission control device 116. The sensor 118 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. It will be appreciated that the engine system 100 is shown in simplified form and may include other components.

A fuel injector 132 is shown coupled directly to the cylinder 104 for injecting fuel directly therein in proportion to a pulse width of a signal received from the controller 120. In this manner, the fuel injector 132 provides what is known as direct injection of fuel into the cylinder 104. The fuel injector may be mounted in the side of the combustion chamber or in the top of the combustion chamber, for example. Fuel may be delivered to the fuel injector 132 by a fuel system 126. In some embodiments, cylinder 104 may alternatively or additionally include a fuel injector arranged in intake manifold 106 in a configuration that provides what is known as port injection of fuel into the intake port upstream of the cylinder 104.

The fuel system 126 includes a fuel tank 128 coupled to a fuel pump system 130. The fuel pump system 130 may include one or more pumps for pressurizing fuel delivered to the injectors 132 of the engine 100, such as the fuel injector 132. While only a single injector 132 is shown, additional injectors are provided for each cylinder. It will be appreciated that fuel system 126 may be a return-less fuel system, a return fuel system, or various other types of fuel system.

Vapors generated in the fuel system 126 may be directed to an inlet of a fuel vapor canister 134 via a vapor recovery line 136. The fuel vapor canister may be filled with an appropriate adsorbent to temporarily trap fuel vapors (including vaporized hydrocarbons) during fuel tank refilling operations and "running loss" (that is, fuel vaporized during vehicle operation). In one example, the adsorbent used is activated charcoal.

In embodiments where engine system 100 is coupled in a hybrid vehicle system, the engine may have reduced operation times due to the vehicle being powered by engine system 100 during some conditions, and by a system energy storage device or motor under other conditions. While the reduced engine operation time reduces overall carbon emissions from the vehicle, it may also lead to insufficient purging of fuel vapors from the vehicle's emission control system. To address this, a fuel tank isolation valve 210 may be optionally included in vapor recovery line 136 such that fuel tank 128 is coupled to canister 134 via the isolation valve 210. During regular engine operation, isolation valve 210 may be kept closed to limit the amount of diurnal or "running loss" vapors directed to canister 134 from fuel tank 128. During refueling operations, and selected purging conditions, isolation valve 210 may be temporarily opened, e.g., for a duration, to direct fuel vapors from the fuel tank 128 to canister 134. By opening the valve during conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 210 positioned along vapor recovery line 136, in alternate embodiments, the isolation valve may be mounted on fuel tank 128.

The fuel vapor canister 134 may be fluidly coupled to a vent line 138 via one or more of air inlets 140. In some embodiments, one or more air inlets 140 may be concomitantly opened by actuating a common vent control valve 146 to fluidly couple fuel vapor canister 134 with the vent line 138. Under some conditions, the vent line 138 may route gases out of the fuel vapor canister 134 to the atmosphere, such as when storing, or trapping, fuel vapors of the fuel system 126. In particular, as elaborated herein, gases may be routed out of the canister via at least one of the plurality of air inlets 140 and then through vent line 138. The fuel vapor canister 134 may be fluidly coupled to a purge line 142 via one or more purge ports 143. In some embodiments, one or more purge ports 143 may be concomitantly opened by actuating a common purge control valve 144 to fluidly couple fuel vapor canister 134 with the purge line 142.

Vent line 138 may allow fresh air to be drawn into the fuel vapor canister 134 when purging stored fuel vapors through one or more purge ports 143 of the fuel vapor canister to the intake manifold 106 via purge line 142. In particular, fresh air may be drawn into the canister via one or more air inlets 140 and purged to the intake manifold via one or more purge ports 143. As described further herein and with regards to FIGS. 3A and 3B, vent line 138 may be coupled to two or more air inlets, and/or may draw fresh air in via one air inlet, and expunge air stripped of fuel vapor via another air inlet. Purge control valve 144 may be positioned in purge line 142 and may be actuated by controller 120 to regulate flow from the fuel vapor canister to the intake manifold 106 while vent control valve 146 positioned in the vent line may be controlled by the controller 120 to regulate the flow of air and vapors between the fuel vapor canister 134 and the atmosphere.

Purge line 142 may couple to air intake passage 108 at junction 160. As shown in FIG. 2, junction 160 is located downstream of throttle 114, but may alternatively be located upstream of throttle 114. When junction 160 is located downstream of throttle 114, intake manifold vacuum may drive airflow through purge line 142 when purge valve 144 is open. In vehicles with low manifold vacuum (such as Hybrid-electric vehicles), the intake manifold vacuum requirement may be eliminated by placing junction 160 upstream of throttle 114. In some embodiments, junction 160 may include a diverter valve (also referred to herein as a balance purge valve). For example, a diverter valve may be positioned in junction 160 when junction 160 is located upstream of throttle 114. By adjusting a position of the diverter valve, the controller may adjust an amount of fresh intake air that is mixed with fuel vapors from a fuel system canister upstream of the throttle. The air mixture may then be delivered to the intake manifold. For engine technologies that do not use a throttle body, the diverter valve may be included in the air induction system (AIS) between the air cleaner and engine intake manifold. For example, in engines configured without an intake throttle and that only operate by controlled intake valve timing (such as in TiVCT engines), purge air may be received between the diverter valve (BPV) and the engine intake valves. Further still, in engines that are configured with a boosting device (such as a turbocharger or supercharger), the diverter valve may be installed between the air cleaner and boosting device. In this way, a diverter valve allows a mixture of atmospheric air to enter the engine's Air Induction System (AIS) in varying amounts from either the air cleaner and or canister system during engine operation.

During purging, a purge air mass may be measured by the engine MAF sensor 122 or referenced from calibrated inferred purge air mass table values. Atmospheric air may enter the fuel vapor canister, during purge, through the engine air cleaner and MAF sensor to measure purge air mass. If not measured by the MAF sensor, purge air mass from the atmosphere entering the canister may be inferred from bench flow data populated in PCM strategy purge air mass tables. Hydrocarbon or oxygen sensor outputs may be used to determine a purge air hydrocarbon concentration which is then controlled using engine air-to-fuel ratio feedback PCM algorithms. In alternate embodiments, an inline sensor and a feed-forward strategy may be used to measure the hydrocarbon concentration of the purge air. The in-line sensor may be located in intake manifold 106, or between junction 160 and intake manifold 106. Alternatively, the in-line sensor may be configured to sense the hydrocarbon concentration in the incoming purge air received within the purge line 142.

Canister 134 may include one or more heating elements 135. The desorption of hydrocarbons from the adsorbent material is an endothermic reaction. By heating the canister prior to and/or during a canister purge operation, the desorption of hydrocarbons is promoted, leading to a higher purge efficiency. Heating element 135 may be coupled internal or external to the canister. Heating element 135 may be an electrical heating element, such as a conductive ceramic element.

Fuel vapor canister 134 may comprise one or more bleed elements (not shown). The bleed element(s) may include, for example, an activated carbon scrubber configured to bind low-concentration hydrocarbon vapor, thus mitigating potential bleed emissions. The bleed element(s) may be positioned at or near the region of fuel vapor canister 134 closest to vent line 138, as desorbed fuel vapor may otherwise be expelled out of the vent line to atmosphere. One or more air inlets 140 may be coupled directly to the bleed element. In this way, the bleed element may be purged concurrently to the rest of the fuel vapor canister, or may be purged separately from the rest of the fuel vapor canister. One or more heating elements may be coupled at or near each bleed element.

The controller 120 is shown in FIG. 1 as a microcomputer, including microprocessor unit 148, input/output ports, a computer readable storage medium 150 for executable programs and calibration values (e.g., read only memory chip, random access memory, keep alive memory, etc.) and a data bus. Storage medium read-only memory 150 can be programmed with computer readable data representing instructions executable by the processor 148 for performing the methods described below as well as other variants that are anticipated but not specifically listed.

The controller 120 may receive information from a plurality of sensors 152 of the engine system 100 that correspond to measurements such as inducted mass air flow, engine coolant temperature, ambient temperature, engine speed, throttle position, manifold absolute pressure signal, air/fuel ratio, fuel fraction of intake air, fuel tank pressure, fuel canister pressure, etc. Note that various combinations of sensors may be used to produce these and other measurements. Furthermore, the controller 120 may control a plurality of actuators 154 of the engine 100 based on the signals from the plurality of sensors 152. Examples of actuators 154 may include vent control valve 146, purge control valve 144, throttle 114, fuel injector 132, etc. Controller 120 may be configured with instructions stored in non-transitory memory, that when executed, cause the controller to perform a control routine. An example control routine is described herein and depicted in FIG. 6.

The purging of fuel vapor from the canister bed is an endothermic reaction. As the bed cools, the desorption of fuel vapor becomes less efficient. Purging operations may thus leave residual hydrocarbons in the canister, potentially leading to bleed emissions, and decreasing the effective adsorbance capacity of the canister bed. By heating air entering the canister during the purge operation, desorption efficiency can be increased. However, operating a canister heating element during each purge cycle will increase battery demand, thus increasing power demand on the engine, and decreasing overall fuel economy.

FIG. 3A schematically shows an example fuel system 300 including a canister ventilation system 301 in accordance with the present disclosure. Fuel system 300 and canister ventilation system 301 may be included in a vehicle system, such as vehicle system 100 as described herein and with regards to FIG. 2.

In this example, vent line 138 is coupled to transmission bellhousing 302. Transmission bellhousing 302 is coupled to engine block 10. Torque converter 305 is coupled to crankshaft 303 via flywheel 304. As torque is applied to crankshaft 303 via the engine or a motor, flywheel 304 rotates torque converter 305 within transmission bellhousing 302. Torque converter 305 comprises impeller 306. Impeller 306 is fixed to torque converter 305. As torque converter 305 rotates, the blades of impeller 306 centrifugally drive torque converter fluid to the outside of torque converter 305. The torque converter fluid, in turn, causes turbine 307 to rotate about stator 308, which propels the fluid back to turbine 307. Turbine 307 is connected to transmission gearbox 18 via output shaft 309. In other configurations, torque converter 305 may be replaced with a manual flywheel which may be coupled to flywheel 304 or coupled directly to crankshaft 303. As torque is applied to the crankshaft, the manual flywheel rotates within the transmission bellhousing.

As such, during engine operation, torque converter 305 couples the engine's output power to gearbox 18. As power is applied to the gearbox, the transmission and torque converter fluids will increase in temperature, heating torque converter 305 and bellhousing 302. Air within the bellhousing may thus be heated upwards of 100° C. By routing the purge air through the bellhousing, the purge air may be heated, thereby increasing the desorption efficiency of the fuel vapor canister. The canister heating element may be used when the bellhousing air has not been warmed (e.g. at cold start), and then may be turned off or limited in use when the bellhousing air reaches a threshold. For vehicles equipped with a manual transmission, the bellhousing may not be heated as much as for vehicles equipped with an automatic transmission. In those examples, the canister heating element may be operated per usual control methods.

Air may enter transmission bellhousing 302 via air inlet 310. An air filter 312 may be coupled within air inlet 310. An additional air filter (not shown) may be included on the outlet side of transmission bellhousing 302. Bellhousing 302 may further include a pump or airflow generator to facilitate transfer of air from air inlet 310 to vent line 138. Although a single air inlet 310 is depicted, in some embodiments, bellhousing 302 may have multiple air inlets, each fitted with an air filter.

Vent valve 315 may regulate air flow between bellhousing 302 and fuel vapor canister inlet(s) 140. In this example, vent valve 315 is configured as a three-way, or changeover valve that is further coupled to fresh air inlet 320. An air filter 322 may be coupled within air filter 322. In this way, fresh air may be drawn in via either air inlet 310 or fresh air inlet 320. Further, air may be expunged from fuel vapor canister 134 via either inlet 310 or fresh air inlet 320. Controller 120 may be configured to control vent valve 315 based on current operating conditions. For example, purge air may preferably be drawn via air inlet 310 in order to ensure that the purge air is heated prior to reaching canister 134. Further, air stripped of fuel vapor following a tank purge or refueling event may preferable be vented via air inlet 320. In some examples, air inlet 320 may be omitted, and stripped air may be vented via air inlet 310.

In some examples, air flow through air inlet 310 and air inlet 320 may be controlled via separate valves. Additionally or alternatively, vent valve 315 or a combination of valves may be configured to allow controller 120 to dictate a mixture of air drawn through the two air inlets. The purge air composition may be based on operating conditions, such as engine speed, canister load, commanded a/f ratio, ambient temperature, etc. If air flow is restricted through either air inlet 310 or 320, the control routine may be altered to only draw air through the non-restricted air inlet. In some examples, air inlet 310 and air inlet 320 may be coupled to different canister air inlets 140. In this way, atmospheric air may be routed to different regions of the fuel vapor canister. For example, in examples where the fuel vapor canister includes a bleed element, a canister air inlet may couple the bleed element to one of air inlet 310 and air inlet 320. FIG. 5 shows an additional example of a multi-inlet fuel vapor canister.

FIG. 3B schematically shows an example fuel system 350 including a canister ventilation system 351 in accordance with the present disclosure. Fuel system 350 and canister ventilation system 351 may be included in a vehicle system, such as vehicle system 100 as described herein and with regards to FIG. 2. In this example, transmission bellhousing 302 includes a dedicated air path 355 coupled between air inlet 310 and vent line 138. In this configuration, a secondary air filter at the transmission bellhousing outlet may be omitted. Further, air inlet 320 (and air filter 322) may also be omitted. In this way, air entering transmission bellhousing 302, be it fresh air or stripped air, will not interact with the internal components of bellhousing 302, but will still be warmed by the internal heat of the bellhousing.

FIG. 4 schematically shows one example air routing system 400 for directing fresh air through transmission bellhousing 302. Bellhousing 302 includes ring gear 405, coupling torque converter 305 to the flywheel. The clearance between ring gear 405 and bellhousing 302 is minimal, trapping air between the teeth of the gear and the bellhousing wall. As such, rotation of the ring gear causes the trapped air to accelerate and flow to areas of greater clearance. Vent line 138 may be coupled to the transmission bellhousing 302 creating such a clearance area. A vortex wall 410 may be placed at the junction of bellhousing 302 and vent line 138 to direct air through the vent line. In some embodiments, bellhousing 302 and torque converter 305 may be configured with side channel and/or centrifugal fan like designs to enhance airflow in a similar fashion to a cross-flow fan. As described herein and with regards to FIG. 3A, an additional air filter may be included at the outlet of vent line 138. Although one air inlet 310 is shown, bellhousing 302 may have multiple air inlets. In some embodiments, multiple air outlets (and accompanying vortex walls, side channel designs, and/or centrifugal fan designs) may be included in bellhousing 302, merging at vent line 138. The air inlets and air outlets may be situated strategically such that the rotational kinetic energy of the ring gear and torque converter is conserved and transferred to the intake air.

The interior wall of the bellhousing may include structures designed to aid the acceleration of air in the direction of the ring gear rotation. Similarly, the ring gears may be designed to further drive air flow. For example, the ring gear may include a plurality of blades 415 or vanes designed to enhance the acceleration of air in the direction of the ring gear rotation. In this way, airflow may be generated within the transmission bellhousing. This may allow the purge air to be routed to the canister in a way that is not dependent on intake manifold vacuum. For examples where junction 160 is located downstream of throttle 114, this may increase the opportunities for canister purging. In examples where junction 160 is located upstream of throttle 114, a diverter valve may thus be omitted.

FIG. 5 schematically shows a first example embodiment of a fuel vapor canister 500 according to an embodiment of the present disclosure. In one example, the canister 500 may be implemented in the engine system 100 shown in FIG. 2, for example, via fuel systems 350. Fuel system 350 may include air routing system 400. It will be appreciated that engine system components introduced in FIGS. 1, 2, 3A, and 4 are numbered similarly and not reintroduced.

The canister 500 includes a tank port 502 fluidly coupled with fuel tank 128. The tank port 502 is a canister inlet that permits fuel vapors that escape from the fuel tank to enter the canister 500 for storage when fuel tank isolation valve 210 is opened. In one example, the canister 500 is filled with activated charcoal to store the received fuel vapors.

The canister 500 includes a plurality of regions 508 (e.g., 1, 2, 3, 4) that may store fuel vapors. In some embodiments, the canister 500 may include a dividing wall 534 that may partially divide the regions of the canister. In alternate embodiments, canister 500 may or may not have a dividing wall and/or air gaps (e.g. for packaging reasons), between each region. In those cases, tunnels and/or flexible hose material may connect each section/region of the canister to one another, thereby preserving the technique of the canister's technology. In particular, the purge port and/or vent connection positions remain, with air being introduced to the ports via a hose or tunnel rather than the housing.

The plurality of regions 508 may be simultaneously purged according to a fuel purging method discussed in further detail below. The canister 500 further includes a plurality of air vents 510, 514, 518, 522, with each air vent associated with a distinct region of the canister and being dedicated to delivering fresh air from the atmosphere to the dedicated region. In the illustrated embodiment, the canister includes four regions and four air vents corresponding to the four regions. Thus, a first canister region (1) may receive fresh air along first air vent 510 (Air Vent 1), while a second canister region (2) receives fresh air along second air vent 514 (Air Vent 2), a third canister region (3) receives fresh air along third air vent 518 (Air Vent 3) and a fourth canister region (4) receives fresh air along fourth air vent 522 (Air Vent 4).

In the illustrated embodiment, two pairs of air vents are located on opposing sides of the canister. Specifically, the first air vent 510 is positioned across from the second air vent 514 while the third air vent 518 is positioned across from the fourth air vent 522. In addition, first air vent 510 and fourth air vent 522 are positioned on a common first side 526 of the canister while second air vent 514 and third air vent 518 are positioned on a second, different side 528 of the canister that opposes first side 526. As such, each air vent is positioned such that during purging of the corresponding region, air flows from that air vent through the region to the nearest purge outlet. By passing intake air through multiple vent ports located at each end of the canister, purge flow restriction reductions are achieved. In some embodiments, each chamber or region of carbon may be divided by an air gap positioned relevant to a closest purge port to further reduce purge flow restrictions. In one example, the restriction reductions achieved could be equal to engine induction system restrictions in order to not cause engine manifold fill miscalculations.

The canister 500 further includes a common vent control valve 546 associated with three of the four air vents. Specifically, vent control valve 546 controls an amount of fresh air received from the atmosphere via transmission bellhousing 302 along vent line 138 and delivered to the canister 500 through second air vent 514 to the second region; third air vent 518 to the third region; and fourth air vent 522 to the fourth region. Air flow into and out of first air vent 510 is not controlled by common vent control valve 546. As such, the uncontrolled air vent corresponds to the air vent that is located furthest away, in terms of fuel vapor flow, from tank port 502. During fuel tank refueling conditions, the vent control valve 546 may be actuated closed by controller 120 so that second, third, and fourth air vents 514, 518, and 522 are closed and only first air vent 510 is open. Consequently, fuel tank vapors entering tank port 502 can be vented to the atmosphere only after flowing through the greatest length of canister adsorbent (e.g., carbon) and exiting via first air vent (as shown by arrow). This increases the residence time of the fuel vapors in the canister and improves their adsorption efficiency. It will be appreciated that while the depicted embodiment of the canister shows three of the four air vents coupled to a common vent control valve, in alternate embodiments of the canister, each air vent may be coupled to a respective vent control valve wherein air flow through each air vent may be controlled by controlling the opening of the respective vent control valve.

Canister 500 further includes a plurality of purge ports including a first purge port 504 and a second purge port 506 fluidly coupled with an intake manifold (e.g., intake manifold 106 shown in FIG. 2). The first and second purge ports 504 and 506 permit fuel vapors desorbed from canister 500 to travel to the intake manifold via purge line 142 during purging, so that the fuel vapors can be consumed by combustion instead of being vented to the atmosphere. Fuel vapors desorbed from the canister may be directed from first purge port 506 into first purge branch 542 and from second purge port 504 into second purge branch 543. From the purge branches 542 and 543, the fuel vapors may be directed to a common purge line 142. The first and second purge ports 504, 506 are positioned on diametrically opposite sides of the canister. Specifically, the first purge port 504 is located on a first side 530 and the second purge port is located on a second side 532 that opposes the first side 530. This allows fuel vapors to be simultaneously purged from the canister to the intake manifold from opposite ends of the canister. In particular, the purge ports being positioned on opposing sides facilitates the purging of fuel vapors from the different regions of the canister in substantially the same or similar manner. In other words, no region is positioned farther away from a purge port than any other region in the canister. Accordingly, the amount of time it takes to purge each region may be similar or substantially the same. The various canister purge ports and air vents may be encompassed within an outer shell or housing (as depicted) and/or passageway of the canister to reduce the number of connections. It will be appreciated that the canister may include any suitable number of purge ports that may be located in any suitable position on the canister without departing from the scope of the present disclosure.

Furthermore, the first and second purge ports 504 and 506 are located on different sides of the canister from the plurality of air vents. As depicted, the purge ports are positioned perpendicular to the air vents. In this way, air flowing through any air vent flows through a corresponding region of the canister to reach a purge outlet. For example, air received through air vents 510 and 514 may be purged through purge port 506 while air received through air vents 518 and 522 may be purged through purge port 504. The dividing wall 534 may help direct air flow through a particular region during purging by at least partially blocking access to other regions of the canister. It will be appreciated that the canister may include any suitable number of air vents that may be located in any suitable position on the canister without departing from the scope of the present disclosure.

The canister 500 further includes a purge control valve 144. Controller 120 may open purge control valve 144 during purging conditions to control an amount of fuel vapors received from purge branches 542 and 543 into purge line 142, and from there to the intake manifold. As such, the fuel vapors may be directed along purge line 142 into engine air intake passage 108 at junction 160 upstream of intake throttle 114. Thus, an amount of fresh air received in the intake passage may be displaced by the ingested fuel vapors. By coupling vent line 138 to air routing system 400, positive air pressure may be generated at the transmission bellhousing, and routed to canister 500 by opening valve 315 (and valve 546). In this way, no diverter valve is needed at junction 160. Alternatively, junction 160 may be placed downstream of throttle 114. In this way, the fuel vapor canister may be purged to intake 106 in a manner that is not dependent on intake manifold vacuum.

FIG. 6 shows a high level flow chart for an example method 600 for purging a fuel vapor canister. Method 600 will be described with regards to the systems depicted in FIGS. 1-4, but it should be understood that similar methods may be used with other systems without departing from the scope of this disclosure. Method 600 may be stored as executable instructions in non-transitory memory and may be executed by controller 120.

Method 600 may begin at 605. At 605, method 600 may include evaluating operating conditions. Operating conditions may be measured, estimated or inferred, and may include various vehicle conditions, such as vehicle speed and vehicle location, various engine operating conditions, such as engine operating mode, engine speed, engine temperature, exhaust temperature, boost level, MAP, MAF, torque demand, horsepower demand, etc. and various ambient conditions, such as temperature, barometric pressure, humidity, etc.

Continuing at 610, method 600 may include determining whether a refueling event is imminent. Determining that a refueling event is imminent may be the result of a direct refueling request. For example, during an engine-off condition, a vehicle operator may depress a refueling request switch, or otherwise attempt to access a refueling conduit coupled to fuel tank 128, for example by opening a refueling door. A refueling event may be inferred, for example, by detecting a proximity to a refueling station via an on-board GPS, or via wireless communication with a refueling pump.

If a refueling event is imminent, method 600 may proceed to 615. At 615, method 600 may include preparing the fuel system for refueling. Preparing the fuel system for refueling may include venting fuel vapors from the fuel tank to the fuel vapor canister. This may include opening FTIV 210 and closing or maintaining closed CPV 144. In examples where a multi-port fuel canister, such as canister 500, is used VCV 546 may be closed or maintained closed. The canister vent valve may be opened or maintained opened in order to allow air stripped of fuel vapor to be expunged to atmosphere. In the example systems shown in FIGS. 3B and 5, the stripped air may be vented through the transmission bellhousing. In the example system shown in FIG. 3A, CVV 315 may be placed in a conformation as to vent the stripped air through a vent line that does not pass through the transmission housing. Following the venting of the fuel tank, a refueling lock (such as a refueling door lock or fuel cap lock) may be released, and the refueling event may proceed.

Continuing at 620, method 600 may include maintaining the aforementioned valves in their relative states for the duration of the refueling event. In this state, fuel vapors generated during the refueling event may be evacuated and stored in the fuel vapor canister, and air stripped of fuel vapor may be vented to atmosphere.

Continuing at 625, at the completion of the refueling event, the FTIV may be closed, sealing the fuel tank. The CVV, CPV, and VCV (where included) may be placed in their default states. Method 600 may then end.

Returning to 610, if no refueling event is imminent, method 600 may proceed to 630. At 630, method 600 may include determining whether purge conditions are met. Determining whether purge conditions are met may include determining canister load, engine operating status, and commanded A/F ratio. If purge conditions are not met, method 600 may proceed to 635. At 635, method 600 may include maintaining the current status of the fuel system. Method 600 may then end.

If purge conditions are met, method 600 may proceed to 640. At 640, method 600 may include initiating a purge event. Initiating a purge event may include closing or maintaining the FTIV closed, and may further include opening the CPV and opening the CVV so as to draw atmospheric air into the fuel vapor canister via the transmission bellhousing. In this way, the purge air will be warmed by the heat of the bellhousing, thus increasing purging efficiency. In examples where a multi-port fuel canister, such as canister 500, is used VCV 546 may be opened to allow purge air to enter all of the canister air vents. In examples where junction 160 includes a diverter valve, the diverter valve may be opened at a duty cycle corresponding to a purge air intake that would incur a commanded a/f ratio.

For some systems, such as the system depicted in FIG. 3A, where purge air may be drawn directly from atmosphere via vent line 320, or drawn via vent line 310 through transmission bellhousing 302, the source of the purge air may be based on operating conditions. For example, purge air may be drawn via vent line 320 during conditions where canister temperature or ambient temperature is above a threshold, where engine speed is below a threshold, or other conditions where no significant increase in purge efficiency is expected by routing the purge air through the transmission bellhousing. In some systems, such as the system depicted in FIG. 4, where the transmission bellhousing is configured to accelerate purge air, purge events may be initiated without regard to intake manifold vacuum.

Continuing at 645, method 600 may include maintaining the aforementioned valves in their respective states for the duration for the duration of the purging event. In this configuration, purge air may flow to the canister via the transmission bellhousing. Purged fuel vapor may then be directed to engine intake for combustion. The purge event may continue for a predetermined duration, until the canister load decreases below a threshold, and/or until purge conditions are no longer met (e.g. a change in engine operating conditions).

Continuing at 650, following the completion of the purge event, the CPV may be closed. Where included, the VCV may also be closed. The CVV may be placed in a default state. Where included, the diverter valve may be placed in a default state. Method 600 may then end.

The method described herein and depicted in FIG. 6 along with the systems described herein and depicted in FIGS. 1-5 may enable one or more systems and one or more methods. In one example, a method, comprising: purging fuel vapors from a fuel vapor canister and/or a fuel vapor bleed element to an engine intake with air routed through a transmission bellhousing. The air routed through the transmission bellhousing may be pressurized at an interface between a bellhousing wall and a ring gear. The air routed through the transmission bellhousing may be routed through a dedicated air path within the transmission bellhousing, the dedicated air path coupled between an air inlet and a vent line, the vent line coupled to the fuel vapor canister. The method may further comprise: passing heat from the transmission bellhousing to the air routed through the transmission bellhousing; and directing heated air to the fuel vapor canister and/or to the fuel vapor bleed element. In some examples, purging fuel vapors from a fuel vapor canister to an engine intake further comprises: directing the purged fuel vapors to engine intake upstream of a throttle body. Directing the purged fuel vapors to engine intake upstream of a throttle body may further comprise: directing the purged fuel vapors to engine intake without directing the purged fuel vapors through a diverter valve. In some examples, the method may further comprise: opening a purge valve coupled between the engine intake and the fuel vapor canister and/or fuel vapor bleed element; and opening a vent valve coupled between the transmission bellhousing and the fuel vapor canister and/or fuel vapor bleed element. The method may further comprise: opening a vent control valve coupled between the vent valve and the fuel vapor canister and/or fuel vapor bleed element; and simultaneously directing air routed through the transmission bellhousing to two or more air vents of the fuel vapor canister and/or fuel vapor bleed element. In some examples, the method may further comprise: simultaneously directing purged fuel vapors to two or more purge ports of the fuel vapor canister and/or fuel vapor bleed element. The technical result of implementing this method is a decrease in bleed emissions, as purge air flowed to the canister may be heated while passing through the transmission bellhousing before being routed to the fuel vapor canister. The heated air will improve the efficiency of desorbing fuel vapors stored in the fuel vapor canister.

In another example, an engine system, comprising: a fuel vapor canister coupled to a fuel tank; a fuel vapor bleed element coupled to the fuel vapor canister; a purge line coupled between an engine intake and one or more of the fuel vapor canister and fuel vapor bleed element; a vent line coupled between a transmission bellhousing and one or more of the fuel vapor canister and fuel vapor bleed element; and one or more air inlets coupled between the transmission bellhousing and atmosphere. In some examples, the one or more air inlets and vent line may be coupled together by a dedicated air path coupled within the transmission bellhousing. The transmission bellhousing may be configured to transfer heat to air flowing from the one or more air inlets to the vent line. The transmission bellhousing may be configured to pressurize atmospheric air, and further configured to flow pressurized air to one or more of the fuel vapor canister and fuel vapor bleed element via the vent line. The transmission bellhousing may further comprise: a vortex wall coupled to a bellhousing wall at a junction between the bellhousing wall and a vent line inlet. The transmission bellhousing may be configured to pressurize atmospheric air between a bellhousing wall and a ring gear. The ring gear may comprise one or blades or vanes designed to enhance the acceleration of air in a direction of rotation of the ring gear. In some examples, the engine system may further comprise an additional air inlet coupled between the vent line and atmosphere, and may further comprise an air filter coupled within the one or more air inlets. The fuel vapor canister may be a multi-port canister including a plurality of vent ports for receiving air routed through the transmission bellhousing, and further including a plurality of purge ports for delivering purge air from the canister to the engine intake. The purge line may be coupled to the engine intake upstream of a throttle body. The vent line and purge line may be coupled to the fuel vapor canister. In some examples, the vent line and purge line may be coupled to the fuel vapor bleed element. The technical result of implementing this engine system is an increase in opportunities to perform purge operations. By pressurizing intake air at the transmission bellhousing, purge air may be generated regardless of engine manifold vacuum, allowing for increased opportunities to perform purge operations. This may in turn reduce bleed emissions, as well as increase engine efficiency, as intake vacuum maybe maintained at a low level. Further, a diverter valve may be omitted, decreasing manufacturing costs and system complexity.

In yet another example, a method for purging a fuel vapor canister, comprising: opening a purge valve coupled between the fuel vapor canister and an engine intake; opening a vent valve coupled between the fuel vapor canister and a transmission bellhousing; flowing atmospheric air into the transmission bellhousing via an air filter; transferring heat to the atmospheric air; pressurizing the atmospheric air in the transmission bellhousing between a bellhousing wall and a ring gear; flowing the heated, pressurized atmospheric air to the fuel vapor canister to purge fuel vapor stored in the fuel vapor canister; and flowing the purged fuel vapor to the engine intake. The method may further comprise: directing the pressurized air to the fuel vapor canister via a vortex wall coupled to the bellhousing wall. The technical result of implementing this method is that purge air may be heated without the addition of a dedicated canister heater or purge air heater. This may reduce manufacturing costs, and increase the efficiency of the vehicle engine and battery, as no additional power or voltage needs to be supplied to warm purge air.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

purging fuel vapors from a fuel vapor canister and/or a fuel vapor bleed element to an engine intake with air routed through a transmission bellhousing, where the air routed through the transmission bellhousing is pressurized at an interface between a bellhousing wall and a ring gear.

2. The method of claim 1, where the air routed through the transmission bellhousing is routed through a dedicated air path within the transmission bellhousing, the dedicated air path coupled between an air inlet and a vent line, the vent line coupled to the fuel vapor canister.

3. The method of claim 1, further comprising:

passing heat from the transmission bellhousing to the air routed through the transmission bellhousing; and directing heated air to the fuel vapor canister and/or to the fuel vapor bleed element.

4. The method of claim 1, where purging fuel vapors from a fuel vapor canister to an engine intake further comprises:

directing the purged fuel vapors to an engine intake upstream of a throttle body.

5. The method of claim 4, where directing the purged fuel vapors to the engine intake upstream of a throttle body further comprises:

directing the purged fuel vapors to the engine intake without directing the purged fuel vapors through a diverter valve.

6. The method of claim 1, further comprising:

opening a purge valve coupled between the engine intake and the fuel vapor canister and/or fuel vapor bleed element; and opening a vent valve coupled between the transmission bellhousing and the fuel vapor canister and/or fuel vapor bleed element.

7. The method of claim 6, further comprising:

opening a vent control valve coupled between the vent valve and the fuel vapor canister and/or fuel vapor bleed element; and simultaneously directing air routed through the transmission bellhousing to two or more air vents of the fuel vapor canister and/or fuel vapor bleed element.

8. The method of claim 7, further comprising:

simultaneously directing purged fuel vapors to two or more purge ports of the fuel vapor canister and/or fuel vapor bleed element.

9. An engine system, comprising:

a fuel vapor canister coupled to a fuel tank;

a fuel vapor bleed element coupled to the fuel vapor canister;

a purge line coupled between an engine intake and one or more of the fuel vapor canister and fuel vapor bleed element;

a vent line coupled between a transmission bellhousing and one or more of the fuel vapor canister and fuel vapor bleed element; and one or more air inlets coupled between the transmission bellhousing and atmosphere.

10. The engine system of claim 9, where the one or more air inlets and vent line are coupled together by a dedicated air path coupled within the transmission bellhousing.

11. The engine system of claim 9, where the transmission bellhousing is configured to transfer heat to air flowing from the one or more air inlets to the vent line.

12. The engine system of claim 9, where the transmission bellhousing is configured to pressurize atmospheric air, and further configured to flow pressurized air to one or more of the fuel vapor canister and fuel vapor bleed element via the vent line.

13. The engine system of claim 12, where the transmission bellhousing further comprises:

a vortex wall coupled to a bellhousing wall at a junction between the bellhousing wall and a vent line inlet.

14. The engine system of claim 12, where the transmission bellhousing is configured to pressurize atmospheric air between a bellhousing wall and a ring gear.

15. The engine system of claim 14, where the ring gear comprises one or more blades designed to enhance the acceleration of air in a direction of rotation of the ring gear.

16. The engine system of claim 9, where the fuel vapor canister is a multi-port canister including a plurality of vent ports for receiving air routed through the transmission bellhousing, and further including a plurality of purge ports for delivering purge air from the canister to the engine intake.

17. The engine system of claim 12, where the vent line and purge line are coupled to the fuel vapor canister.

18. The engine system of claim 12, where the vent line and purge line are coupled to the fuel vapor bleed element.

19. A method for purging a fuel vapor canister, comprising:

opening a purge valve coupled between the fuel vapor canister and an engine intake;

opening a vent valve coupled between the fuel vapor canister and a transmission bellhousing;

flowing atmospheric air into the transmission bellhousing via an air filter;

transferring heat to the atmospheric air;

pressurizing the atmospheric air in the transmission bellhousing between a bellhousing wall and a ring gear;

flowing the heated, pressurized atmospheric air to the fuel vapor canister to purge fuel vapor stored in the fuel vapor canister; and flowing the purged fuel vapor to the engine intake.

20. A method, comprising:

opening a purge valve coupled between an engine intake and a fuel vapor canister and/or a fuel vapor bleed element;

opening a vent valve coupled between a transmission bellhousing and the fuel vapor canister and/or the fuel vapor bleed element; and purging fuel vapors from the fuel vapor canister and/or the fuel vapor bleed element to the engine intake with air routed through the transmission bellhousing.

* * * * *